US008496041B2

(12) United States Patent
Li

(10) Patent No.: US 8,496,041 B2
(45) Date of Patent: Jul. 30, 2013

(54) LADDER TAPE FOR WINDOW COVERING AND SLAT ADJUSTING APPARATUS USING THE LADDER TAPE

(75) Inventor: Chen-Hsing Li, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 13/404,222

(22) Filed: Feb. 24, 2012

(65) Prior Publication Data

US 2013/0133842 A1 May 30, 2013

(30) Foreign Application Priority Data

Nov. 29, 2011 (TW) ..... 100222565 U

(51) Int. Cl.
*E06B 9/382* (2006.01)

(52) U.S. Cl.
USPC ..... 160/178.3; 139/384 A

(58) Field of Classification Search
USPC ..... 160/178.3, 177 R, 178.1 R, 173 R, 160/168.1 R; 139/384 A
See application file for complete search history.

(56) References Cited

U.S. PATENT DOCUMENTS

| | | | | |
|---|---|---|---|---|
| 2,142,900 | A * | 1/1939 | Hinlein et al. | 66/170 |
| 2,275,273 | A * | 3/1942 | Taylor | 66/170 |
| 2,420,978 | A * | 5/1947 | Rasero | 139/384 A |
| 2,590,889 | A * | 4/1952 | Rasero | 139/384 A |
| 2,775,265 | A * | 12/1956 | O'Brien et al. | 139/384 A |
| 3,256,928 | A * | 6/1966 | Hensel | 160/178.3 |
| 4,945,971 | A * | 8/1990 | Ivarsson et al. | 160/178.3 |
| 5,074,349 | A * | 12/1991 | Yannazzone | 160/177 R |
| 5,341,865 | A * | 8/1994 | Fraser et al. | 160/176.1 R |
| 5,921,306 | A * | 7/1999 | Smederod | 160/177 R |
| 7,055,572 | B2 * | 6/2006 | Nien et al. | 160/178.3 |

* cited by examiner

*Primary Examiner* — David Purol
(74) *Attorney, Agent, or Firm* — Tracy M. Heims; Apex Juris, pllc

(57) ABSTRACT

A ladder tape includes two pairs of warp strings, and two weft strings repeatedly passing through the warp strings in a predetermined way to form two cords and a plurality of bridge sections between the cords. The weft strings respectively are wound around one section of each pair of the warp strings only to form an opening between the warp strings that the ladder tape may engage with the rotary drum of the window blind in a fast and easy way. The weft strings are wound around the warp strings in a way that the ladder tape will not get entangled with other objects unexpectedly.

10 Claims, 7 Drawing Sheets

LADDER TAPE FOR WINDOW COVERING AND SLAT ADJUSTING APPARATUS USING THE LADDER TAPE

BACKGROUND OF THE INVENTION

1. Field of the Invention

The present invention relates generally to a cord and its application, and more particularly to a ladder tape for a window covering and a slat adjusting apparatus of a window blind using the ladder tape.

2. Description of the Related Art

There are lots of ways to weave cords for various purposes of a ladder tape. FIG. 1 and FIG. 2 show a conventional ladder tape 1 for a window blind. The ladder tape 1 includes two parallel cords, each of which has a weft string 1*a* and two warp strings 1*b*, 1*c*. The weft string 1*a* winds around the warp strings 1*b*, 1*c* in a specific way. The weft string 1*a* forms several transverse coupling sections 1*d* to support slats 2 of the window blind (as shown in FIG. 1) and an unwound section 1*e* (as shown in FIG. 2). The unwound section 1*e* lets the warp string s 1*b*, 1*c* having an unbounded section that an opening 1*f* is formed between the warp strings 1*b*, 1*c*.

As shown in FIG. 2, a pin 3 passes through a gap 1*g* between the unwound section 1*e* and the weft string 1*b*, and then passes through the opening 1*f* through a path L. The pin 3 has a neck 3*a* that will be arranged to be located between the warp strings 1*b*, 1*c* so that the warp strings 1*b*, 1*c* may hold the pin 3. Next, the pin 3 is inserted into a rotary drum 4. The rotary drum 4 has a plate 4*a* to cover and press the pin 3 thereunder so to fix the pin 3 with the rotary drum 4. The rotary drum 4 is rotated to move the ladder tape 1 and tilt the slats 2.

The conventional apparatus for controlling the slats 2 has the following drawbacks:

1. The ladder tape 1 are fastened to the rotary drum 4 using an additional pin 3 that is difficult to assemble and the ladder tape 1 may be disengaged with the rotary drum 4 easily if the pin 3 becomes loose within the rotary drum 4.

2. The pin 3 is inserted into the gap 1*g* between the unwound section 1*e* and the warp string 1*b* and the opening 1*f* that will have a risk of breaking the unwound section 1*e*.

3. The unwound section 1*e* may be entangled with other objects unexpectedly because it is exposed without any protection.

SUMMARY OF THE INVENTION

The primary objective of the present invention is to provide a ladder tape, which is not easily entangled with other objects unexpectedly.

According to the objective of the present invention, a ladder tape includes a first warp string, a second warp string, a third warp string, a fourth warp string; and at least two first weft strings repeatedly passing through the warp strings in a predetermined way. The first warp string and the second warp string are wound by a first weft string to form a first cord, and the third warp string and the fourth warp string are wound by the other first weft string to form a second cord. The first weft strings respectively have a plurality of first sections alternately wound around the first warp string and the second warp string, a plurality of second sections alternately wound around the third warp string and the fourth warp string. The first weft strings have a plurality of bridge sections between the first cord and the second cord, and opposite ends of each bridge sections respectively connect to the corresponding first section and the corresponding second section. The first weft strings respectively have a winding section wound around the first warp string to form a first opening between the first warp string and the second warp string, and wound around the third warp string only to form a second opening between the third warp string and the fourth warp string.

The present invention further provides a slat adjusting apparatus of a window blind, including a rotary drum and a ladder tape. The ladder tape has a first warp string, a second warp string, a third warp string, a fourth warp string, and at least two first weft strings repeatedly passing through the warp strings. The first weft strings respectively have a winding section wound around the first warp string to form a first opening between the first warp string and the second warp string, and wound around the third warp string only to form a second opening between the third warp string and the fourth warp string.

In an embodiment, the first warp string and the second warp string are interlaced with each other at a region above and under the first opening, and the third warp string and the fourth warp string are interlaced with each other at a region above and under the second opening.

In an embodiment, the first warp string and the second warp string respectively have a high knitting density section at a region around the first opening, and the third warp string and the fourth warp string respectively have a high knitting density section at a region around the second opening.

In an embodiment, the ladder further includes at least two second weft strings repeatedly passing through the warp strings in a way opposite to the first weft strings, wherein the second weft strings have a plurality of first sections alternately wound around the first warp string and the second warp string, a plurality of second sections alternately wound around the third warp string and the fourth warp string, and a plurality of bridge sections between the first cord and the second cord; wherein opposite ends of the bridge section respectively connect to the corresponding first section and the corresponding second section; and wherein the second weft strings respectively have a winding section wound around the second warp string within the first opening and the fourth warp string within the second opening.

The present invention overcomes the drawbacks of the conventional device. It has no hanging string to get entangled unexpectedly. When the ladder tape of the present invention is mounted on a window blind, it may engage the first and the second openings to the coupling portion of the rotary drum in an easy and fast way.

DETAILED DESCRIPTION OF THE INVENTION

Figure 1:
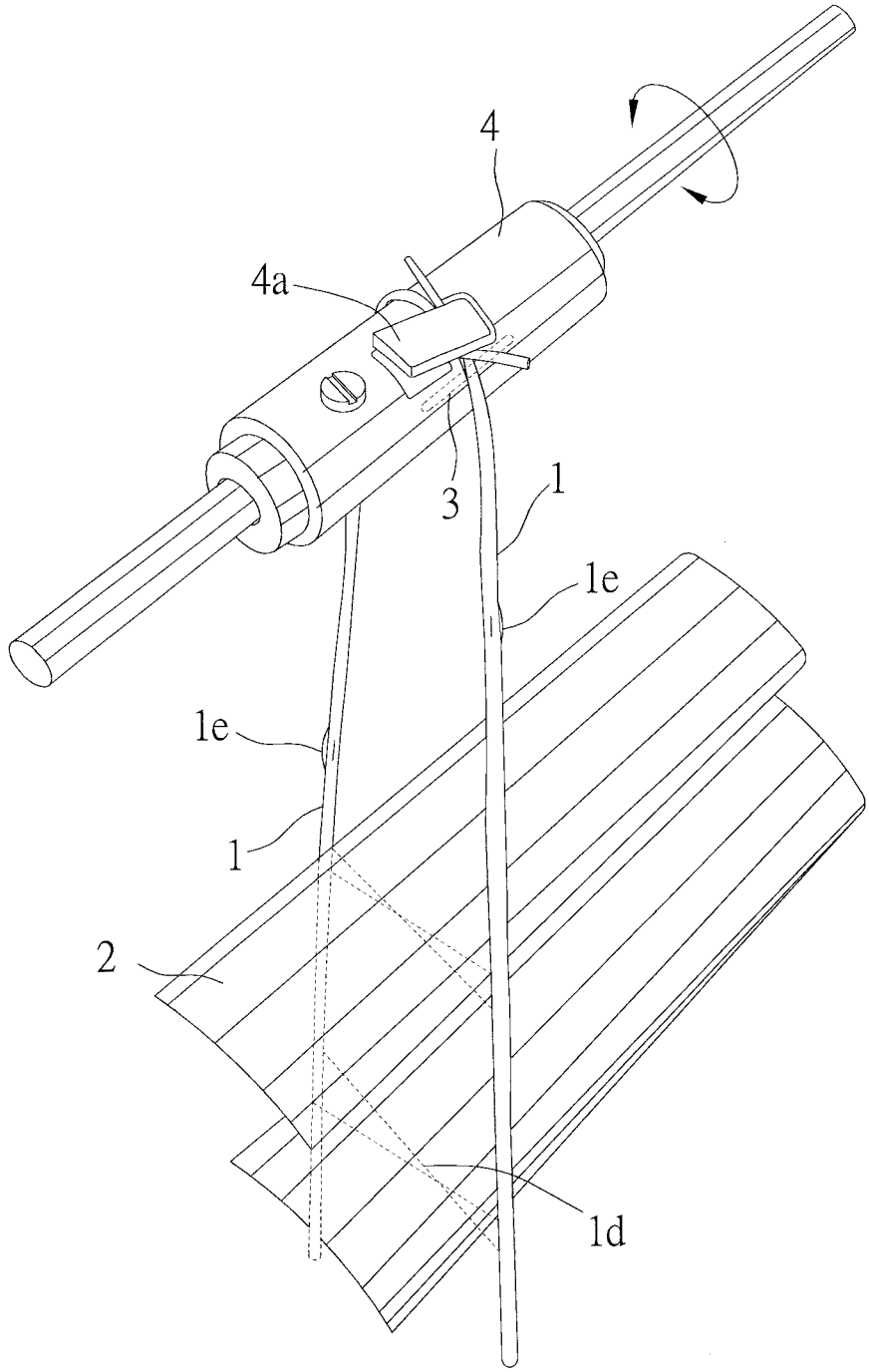
FIG. 1 (PRIOR ART)
FIG. 1 is a perspective view of the conventional window blind.
Figure 2:
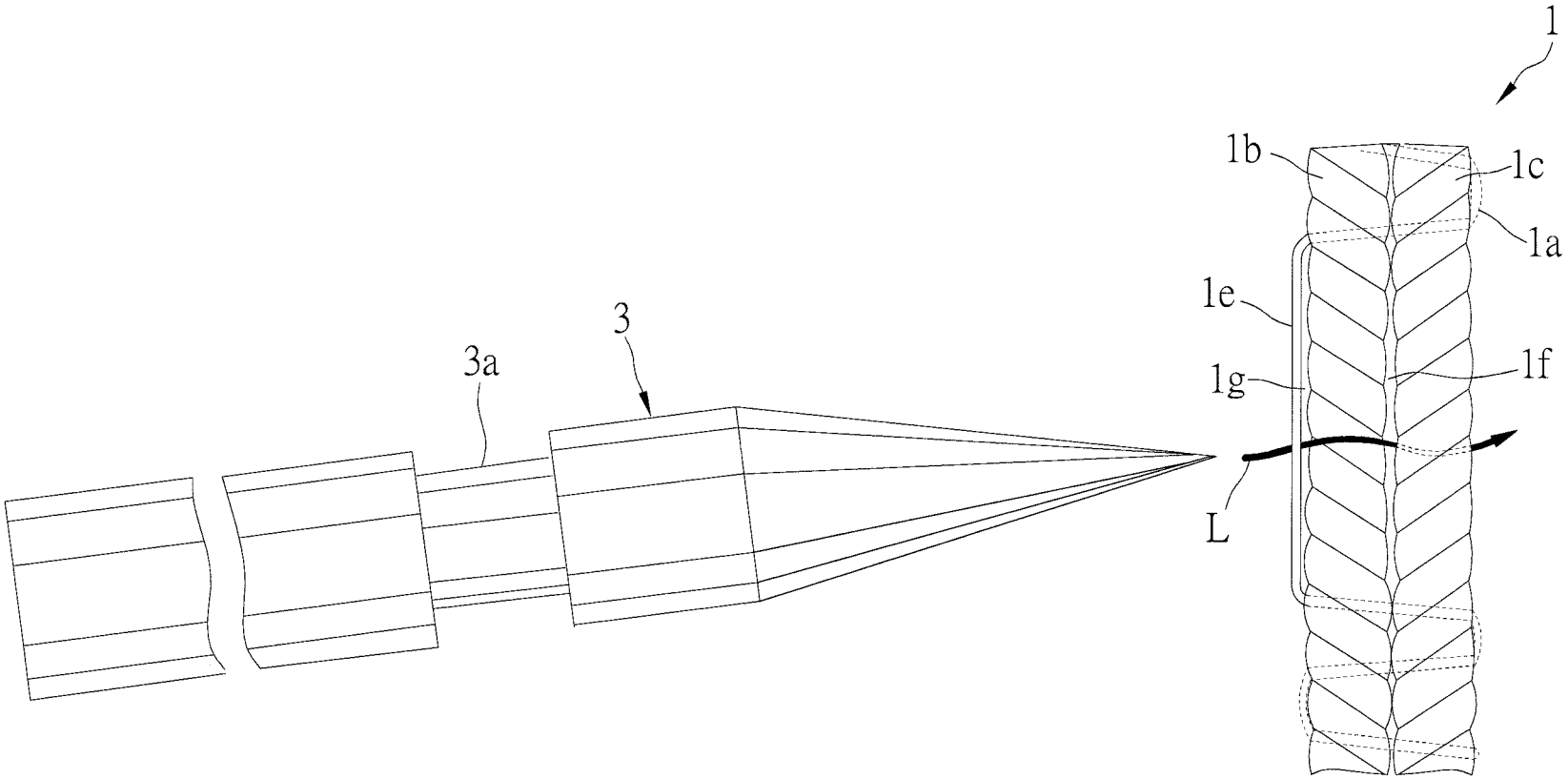
FIG. 2 (PRIOR ART)
FIG. 2 is a perspective view of the conventional ladder tape and the pin.
Figure 3:
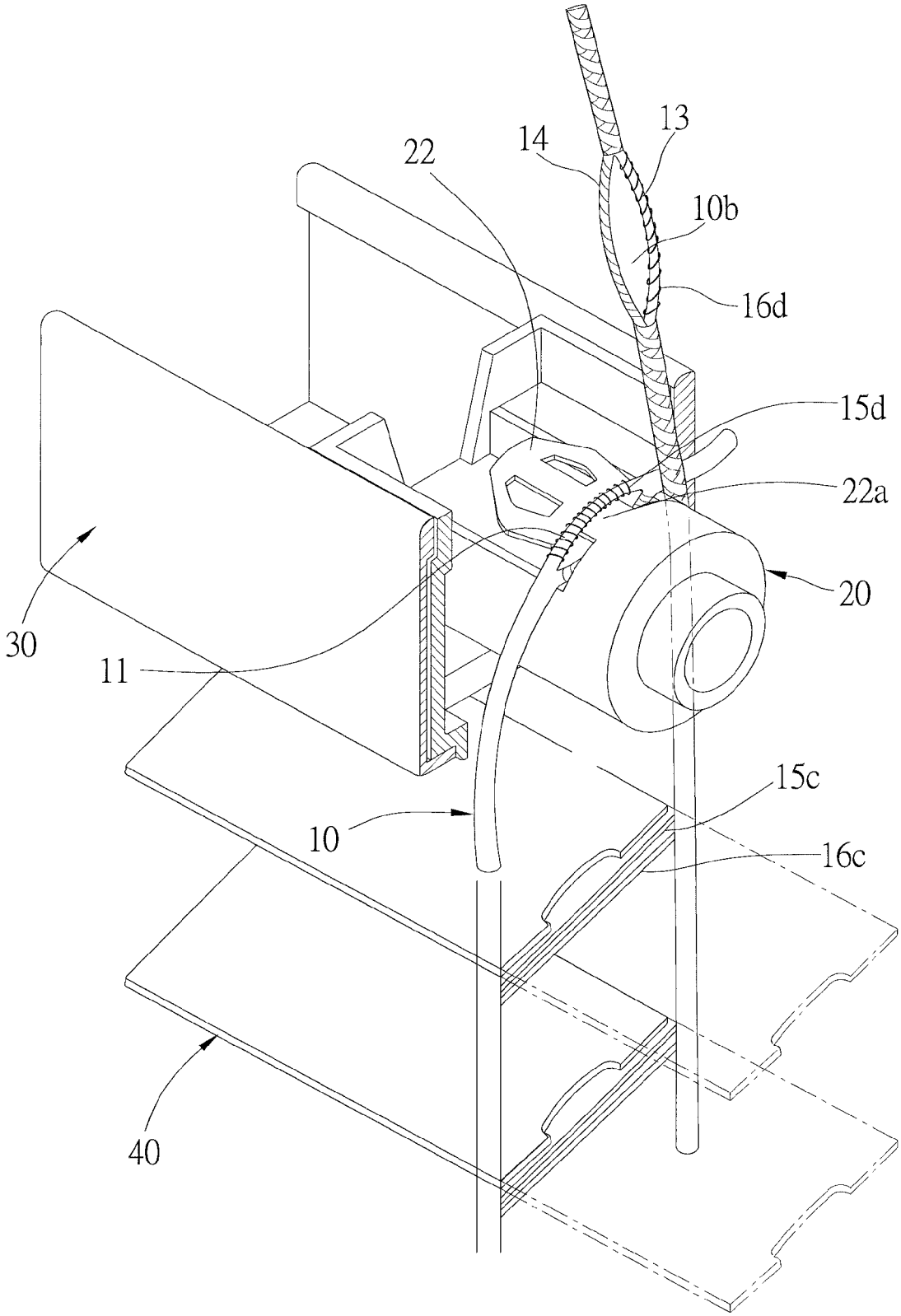
FIG. 3 is a perspective view of the first preferred embodiment of the present invention.

As shown in FIG. 3, a ladder tape 10 of the first preferred embodiment of the present invention is incorporated in a window blind. The window blind has a top rail 30, in which a rotary drum 20 is provided to be turned. In the present invention, the rotary drum 20 is a barrel has a protrusion 22 to form a coupling portion, and the protrusion 22 has a neck 22*a*. The neck 22*a* is a thinner portion of the protrusion 22.

Figure 4:
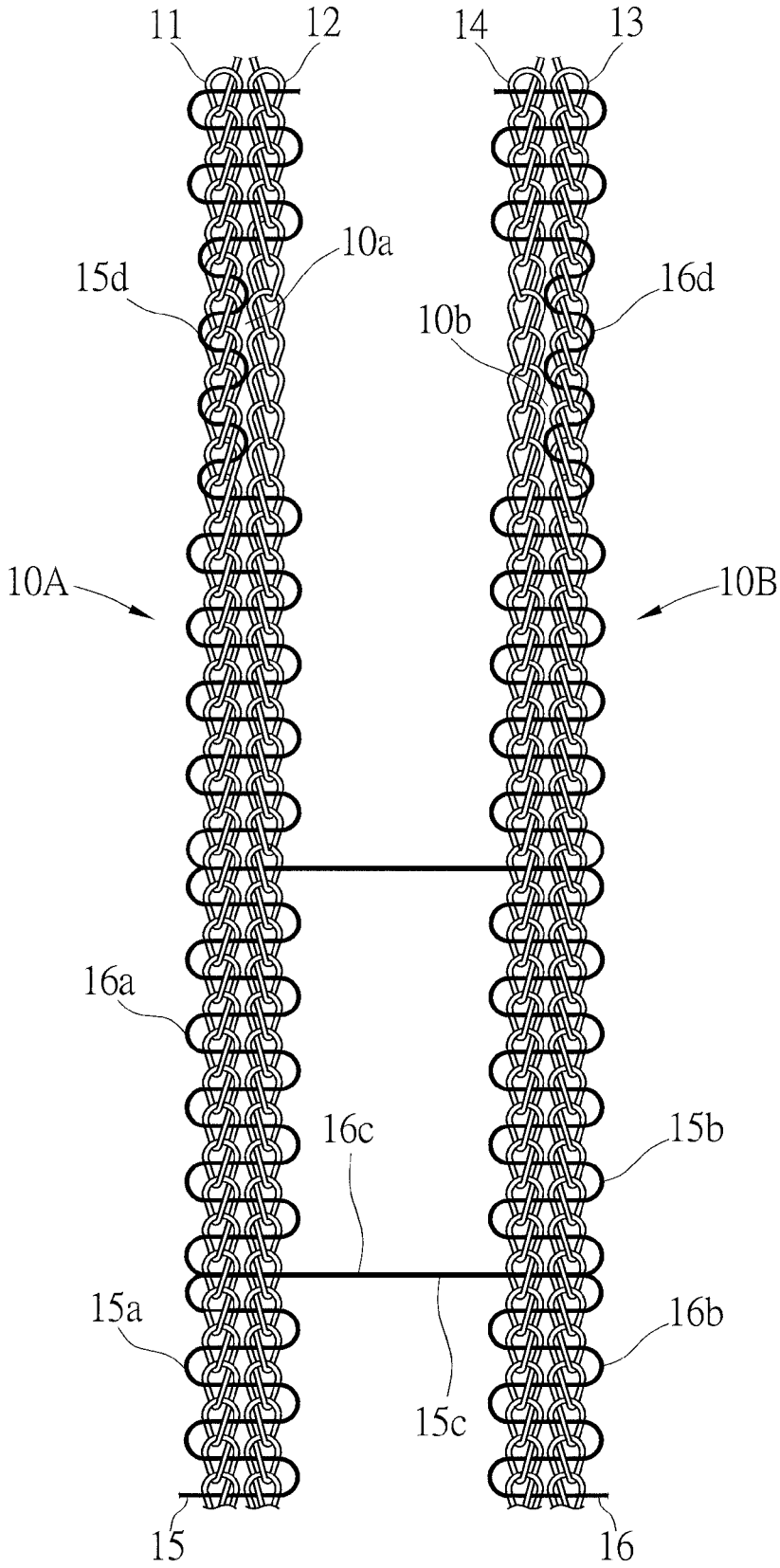
FIG. 4 is a sketch diagram of the ladder tape of the first preferred embodiment of the present invention.

As shown in FIG. 4, the ladder tape 10 of the first preferred embodiment has a first warp string 11, a second warp string 12, a third warp string 13, a fourth warp string 14, and two first weft strings 15, 16. The first weft strings 15, 16 repeatedly pass through the warp strings 11-14 to be wound around the warp strings 11-14 in a predetermined way to form the ladder tape 10. The first weft string 15 repeatedly passes through the first and the second warp strings 11, 12 for a predetermined length, and then goes to the third and the fourth warp strings 13, 14 to repeatedly pass through them for a predetermined length, and then goes back to the first and the second warp strings 11, 12 for the same. The first weft string 16 is opposite to the first weft string 15, it starts from the third and the fourth warp strings 13, 14, goes to the first and the second warp strings 11, 12, and then goes back to the third and the fourth warp strings 13, 14. The first weft strings 15, 16 go between the first and the second warp strings 11, 12 and the third and the fourth warp strings 13, 14 for several times. The first and the second warp strings 11, 12 are wound by the first weft strings 15, 16 to form a first cord 10A, and the third and the fourth warp strings 13, 14 are wound by the first weft strings 15, 16 to form a second cord 10B. The first weft string 15 has a plurality of first sections 15*a* and second sections 15*b*, in which the first sections 15*a* are the parts of the first weft string 15 being wound around the first and the second warp strings 11, 12, and the second sections 15*b* are the parts of the first weft string 15 being wound around the third and the fourth warp strings 13, 14. The first weft string 16 has a plurality of first sections 16*a* and second sections 16*b*, in which the first sections 16*a* are the parts of the first weft string 16 being wound around the first and the second warp strings 11, 12, and the second sections 16*b* are the parts of the first weft string 16 being wound around the third and the fourth warp strings 13, 14. Therefore, on the first cord 10A has alternate the first sections 15*a*, 16*a*, and on the second cord 10B has alternate the first sections 15*b*, 16*b*. The first weft strings 15, 16 form several bridge sections 15*c*, 16*c* between the first cord 10A and the second cord 10B to support slats 40.

The first weft string 15 further has a winding section 15*d* which is wound around the first warp string 11 only, and the first weft string 16 further has a winding section 16*d* which is wound around the third warp string 13 only. Consequently, the first cord 10A has a first opening 10*a* between the first and the second warp strings 11, 12 beside the winding section 15*d*, and the second cord 10B has a second opening 10*b* between the third and the fourth warp strings 13, 14 beside the winding section 16*d*. The first cord 10A and the second cord 10B are fastened to the rotary drum 20 by engaging the first and the second openings 10*a*, 10*b* of the first cord 10A and the second cord 10B to the protrusion 22 of the rotary drum 20. The first cord 10A and the second cord 10B will be rested in the neck 22*a* of the protrusion 22.

The present invention has the following advantages:

1. No fastener (such as the pin of the prior art) is needed to connect the ladder tape to the window blind. It only needs to fit the first and the second openings 10*a*, 10*b* of the ladder tape 10 to the protrusion 22 of the rotary drum 20.

2. The first weft strings 15, 16 have the winding sections 15*d*, 16*d* wound around the corresponding warp strings within the first and the second openings 10*a*, 10*b*. It will help the first and the second cords 10A, 10B to form the first and the second openings 10*a*, 10*b*, and furthermore, there is no hanging string besides the opening that the ladder tape 10 of the present invention will not get entangled unexpectedly.

3. The first and the second openings 10*a*, 10*b* are not formed by cutting the cords 10A, 10B. They are formed naturally after the warp strings 11-14 being wound by the first weft strings 15, 16. Besides, the first and the second openings 10*a*, 10*b* are between the warp strings that the ladder tape 10 is strong enough to hold the slats when the first and the second openings 10*a*, 10*b* are fit to the protrusion 22 of the rotary drum 20.

The following embodiments provide different structures to enhance the strength of the first and the second openings 10*a*, 10*b* of the ladder tape 10.

Figure 5:
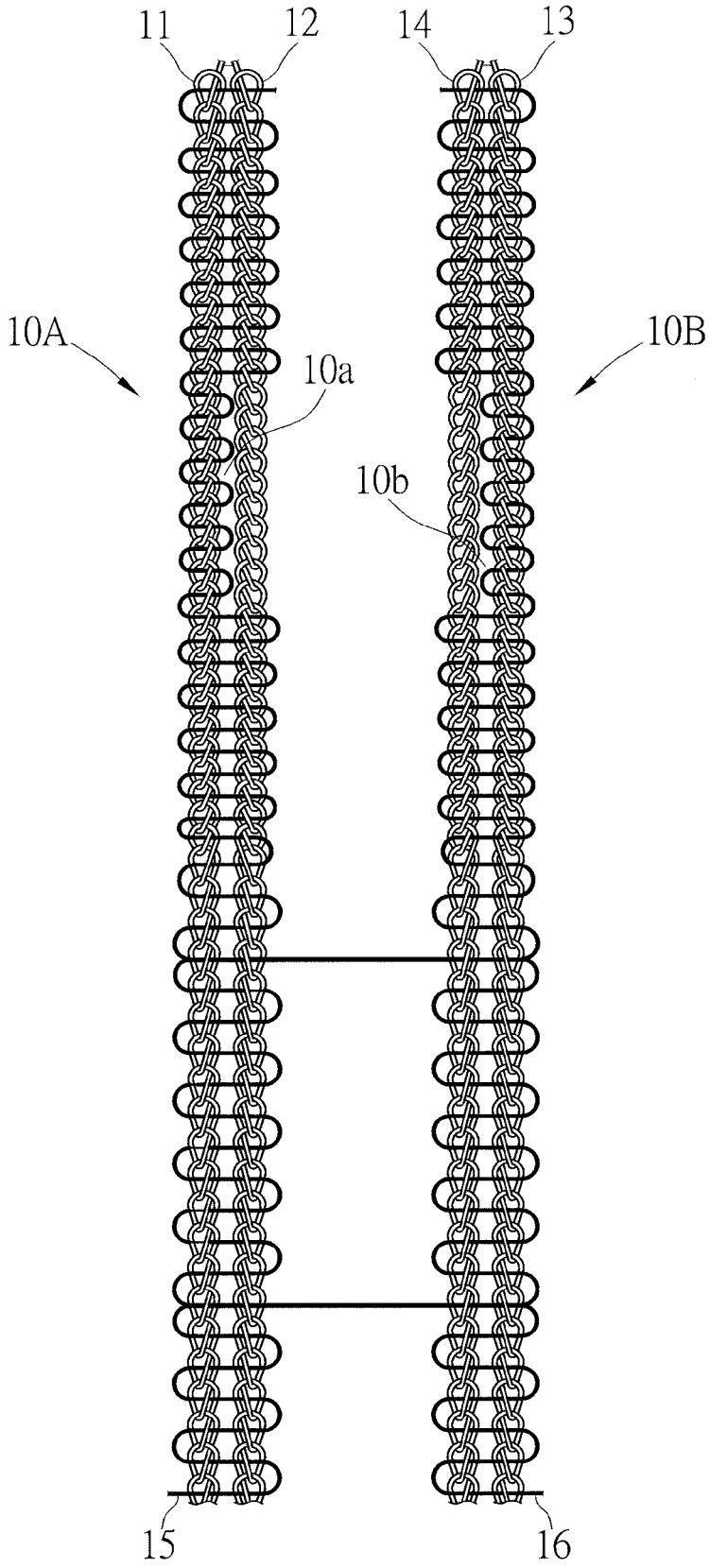
FIG. 5 is a sketch diagram of the ladder tape of a second preferred embodiment of the present invention.

FIG. 5 shows a ladder tape of the second preferred embodiment of the present invention. The warp strings 11 to 14 have different knitting intensities in different parts. The warp strings 11 to 14 respectively have a high knitting density section around the first and the second openings 10*a*, 10*b*, in other words, the knitting densities around the first and the second openings 10*a*, 10*b* are higher than the rest pars of the warp strips 11 to 14. Also, the first weft strings 15, 16 can have longer sections, thus denser knitting, wound around the high density sections, and therefore, the strengths around the first and the second openings 10*a*, 10*b* increase. As a result, the portions around the openings 10*a*, 10*b* are stronger.

Figure 6:
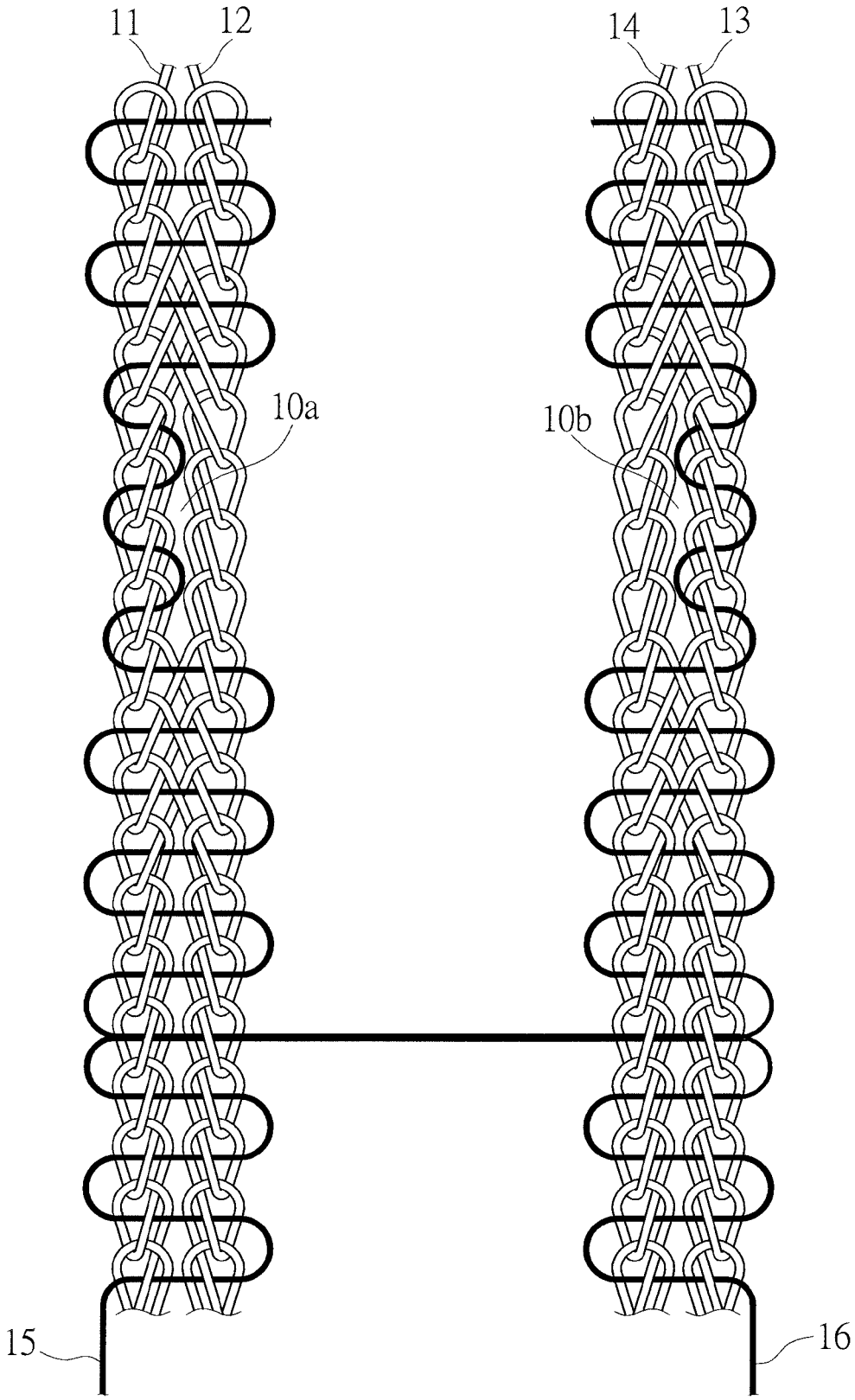
FIG. 6 is a sketch diagram of the ladder tape of a third preferred embodiment of the present invention.

FIG. 6 shows a ladder tape of the third preferred embodiment of the present invention. The first warp string 11 and the second warp string 12 are interlaced with each other at a region above and under the first and the second openings 10*a*, and the third warp string 13 and the fourth warp string 14 are interlaced with each other at a region above and under the first and the second openings 10*b*. It enhances the strength of the first and the second openings 10*a*, 10*b* as well.

Figure 7:
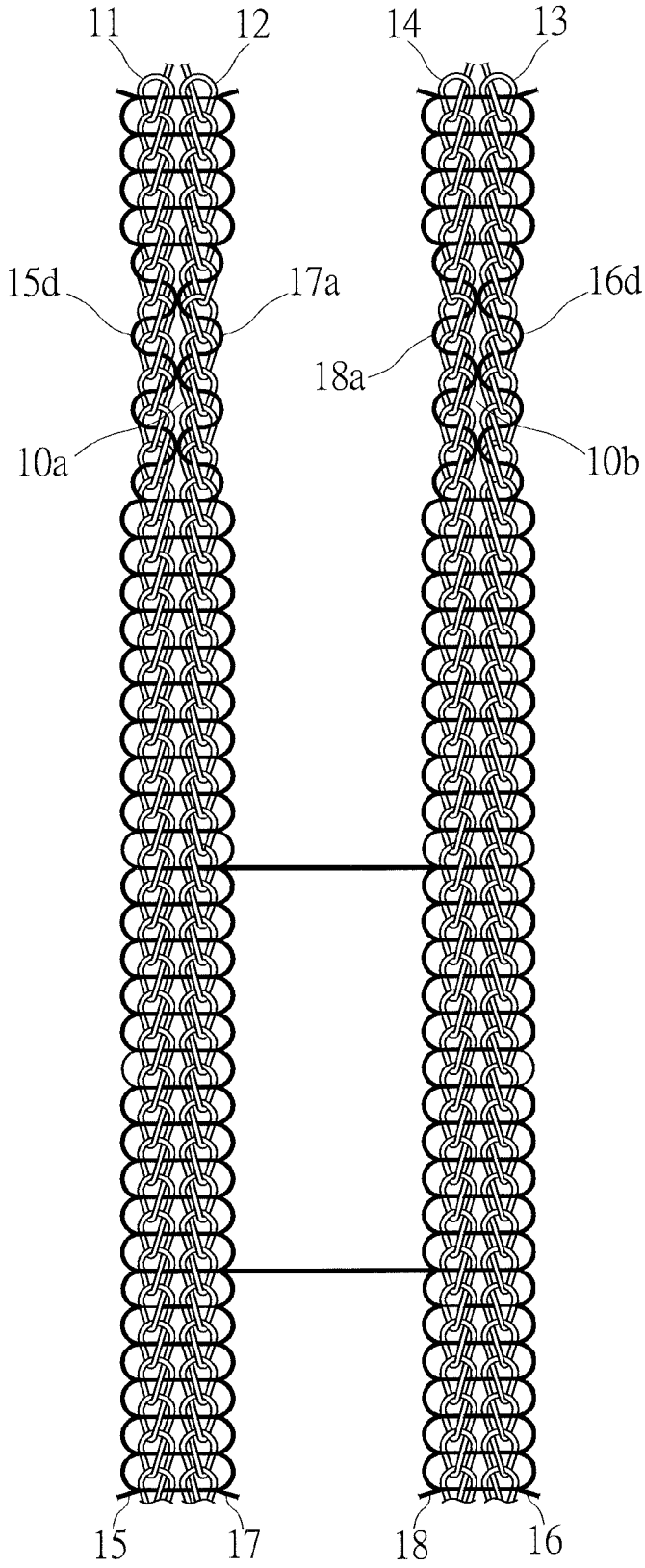
FIG. 7 is a sketch diagram of the ladder tape of a fourth preferred embodiment of the present invention.

As shown in FIG. 7, a ladder tape of the fourth preferred embodiment of the present invention further includes a pair of second weft strings 17, 18. The second weft strings 17, 18 repeatedly pass through the warp strings 11-14 to be wound around the warp strings 11 to 14 in a way opposite to the first weft strings 15, 16 respectively. Therefore, the sections of the warp strings 11 to 14 within the first and the second openings 10*a*, 10*b* are respectively wound by the first and the second weft strings 15 to 18. Precisely, the first and the second warp strings 11 and 12 within the first opening 10*a* are wound by the winding sections 15*a* and 17*a* of the first weft strings 15 and the second weft strings 17, and the third and the fourth warp strings 13 and 14 within the second opening 10*b* are wound by the winding sections 16*a* and 18*a* of the first weft strings 16 and the second weft strings 18. It enhances the total strength of the ladder tape.

The description above is a few preferred embodiments of the present invention and the equivalence of the present invention is still in the scope of claim construction of the present invention.

What is claimed is:

1. A ladder tape, comprising:

a first warp string, a second warp string, a third warp string, and a fourth warp string; and at least two first weft strings repeatedly passing through the warp strings in a predetermined way;

wherein the first warp string and the second warp string are wound by the first weft strings to form a first cord, and the third warp string and the fourth warp string are wound by first weft strings to form a second cord;

wherein the first weft strings respectively have a plurality of first sections alternately wound around the first warp string and the second warp string, a plurality of second sections alternately wound around the third warp string and the fourth warp string;

wherein the first weft strings have a plurality of bridge sections between the first cord and the second cord, and opposite ends of each bridge sections respectively connect to the corresponding first section and the corresponding second section;

wherein the first weft strings respectively have a winding section wound around the first warp string to form a first opening between the first warp string and the second warp string, and wound around the third warp string only to form a second opening between the third warp string and the fourth warp string.

2. The ladder tape as defined in claim 1, wherein the first warp string and the second warp string are interlaced with each other at a region above and under the first opening, and the third warp string and the fourth warp string are interlaced with each other at a region above and under the second opening.

3. The ladder tape as defined in claim 1, wherein the first warp string and the second warp string respectively have a high density section at a region around the first opening, and the third warp string and the fourth warp string respectively have a high density section at a region around the second opening.

4. The ladder tape as defined in claim 1, further comprising at least two second weft strings repeatedly passing through the warp strings in a way opposite to the first weft strings, wherein the second weft strings have a plurality of first sections alternately wound around the first warp string and the second warp string, a plurality of second sections alternately wound around the third warp string and the fourth warp string, and a plurality of bridge sections between the first cord and the second cord; wherein opposite ends of the bridge section respectively connect to the corresponding first section and the corresponding second section; and wherein the second weft strings respectively have a winding section wound around the second warp string within the first opening and the fourth warp string within the second opening.

5. A slat adjusting apparatus of a window blind, comprising:

a rotary drum having a coupling portion; and a ladder tape having a first warp string, a second warp string, a third warp string, a fourth warp string, and at least two first weft strings repeatedly passing through the warp strings;

wherein the first weft strings respectively have a winding section wound around the first warp string and the third warp string only to form a first opening between the first warp string and the second warp string, and a second opening between the third warp string and the fourth warp string;

wherein the coupling portion of the rotary drum engages the first opening and the second opening to connect the ladder tape to the rotary drum.

6. The slat adjusting apparatus as defined in claim 5, wherein the coupling portion of the rotary drum has a protrusion with a neck, and the first opening and the second opening of the ladder tape are fitted to the protrusion and rested in the neck.

7. The slat adjusting apparatus as defined in claim 5, wherein the first warp string and the second warp string are interlaced with each other at a region above and under the first opening, and the third warp string and the fourth warp string are interlaced with each other at a region above and under the second opening.

8. The slat adjusting apparatus as defined in claim 5, wherein the first warp string and the second warp string are wound by the first weft strings to form a first cord, and the third warp string and the fourth warp string are wound by first weft strings to form a second cord; wherein the first weft strings have a plurality of first sections alternately wound around the first warp string and the second warp string, a plurality of second sections alternately wound around the third warp string and the fourth warp string, and a plurality of bridge sections between the first cord and the second cord, and opposite ends each of the bridge sections respectively connect to the corresponding first section and the corresponding second section.

9. The slat adjusting apparatus as defined in claim 8, wherein the first warp string and the second warp respectively have a high density section at a region around the first opening, and the third warp string and the fourth warp string respectively have a high density section at a region around the second opening.

10. The slat adjusting apparatus as defined in claim 5, further comprising at least two second weft strings repeatedly passing through the warp strings in a way opposite to the first weft strings, wherein the second weft strings have a plurality of first sections alternately wound around the first warp string and the second warp string, a plurality of second sections alternately wound around the third warp string and the fourth warp string, and a plurality of bridge sections connect to the corresponding first sections and the corresponding second sections; and wherein the second weft strings respectively have a winding section wound around the second warp string within the first opening and the fourth warp string within the second opening.

* * * * *